United States Patent [19]

Lee

[11] 3,979,026

[45] Sept. 7, 1976

[54] APPARATUS FOR DISPENSING PARTICULATE AND VISCOUS LIQUID MATERIAL

[76] Inventor: Roger Howard Lee, 69 Bramstead Ave., Compton Ridge, Wolverhampton WV6 8AT, England

[22] Filed: Sept. 16, 1974

[21] Appl. No.: 506,161

[52] U.S. Cl. ..... 222/167; 259/3

[51] Int. Cl.[2] ..... B67D 5/64

[58] Field of Search ..... 222/144, 160, 169, 167, 222/196, 564, 460, 461, 462, 519, 520, 548, 411, 242; 259/3, 14, 175, 176, 177 R, 177 A

[56] References Cited

UNITED STATES PATENTS

| | | | |
|---|---|---|---|
| 2,394,453 | 2/1946 | Huszar | 222/167 X |
| 2,500,698 | 3/1950 | Mills | 222/242 X |
| 3,197,078 | 7/1965 | Kuperschmid | 222/169 |
| 3,471,063 | 10/1969 | Jung et al. | 222/167 |
| 3,752,445 | 8/1973 | Nowak | 259/14 X |

FOREIGN PATENTS OR APPLICATIONS

| | | | |
|---|---|---|---|
| 606,995 | 7/1933 | Germany | 259/3 |

*Primary Examiner*—Robert B. Reeves
*Assistant Examiner*—Joseph J. Rolla
*Attorney, Agent, or Firm*—Stewart and Kolasch, Ltd.

[57] ABSTRACT

An apparatus for dispensing particulate material or a viscous liquid which consists of a cylindrical material container section, a frustoconical chamber and an end plate mounted so as to separate the container and chamber. The container and chamber are rotated about an inclined longitudinal axis by an electric motor and gear drive; while the end plate is stationary. The end plate defines a circumferential inlet for passing material from the container to chamber outlet and agitates the material to prevent lumping. An agitating probe mounted in the circumferential inlet and a fixed scouring brush are also employed to ensure proper flow.

2 Claims, 7 Drawing Figures

APPARATUS FOR DISPENSING PARTICULATE AND VISCOUS LIQUID MATERIAL

This invention relates to a method of dispensing measured quantities of a particulate material or a viscous liquid, and to an apparatus for carrying out the method.

According to one aspect of the invention, a method of dispensing a particulate or a viscous liquid material comprises introducing such material continuously into the wider end of a rotating frustoconical chamber which is mounted with its axis at such an angle to the horizontal that that portion of the frustoconical wall of the chamber which at any instant is lowermost forms a channel which is either horizontal or slopes upwards at a small angle from the wider end of the chamber to the narrower end of the chamber, and allowing the material to flow out of the chamber through an outlet at said narrower end.

The rate of flow of the material through the chamber may be controlled, preferably by varying the speed of rotation of the chamber, but alternatively by varying the angle of inclination to the horizontal of the chamber axis. The rate of rotation is preferably always less than 40 r.p.m., for non free-flowing materials. The material may be introduced into the wider end of the chamber by various methods.

For example, a cylindrical tube containing particulate material may be fixed to the wider end of the chamber and coaxial with it so that the tube is inclined to the horizontal, preferably by at least 25°, and the chamber being separated by a circular plate having a narrow circumferential aperture at the bottom in the wider part of the chamber. The cylindrical tube may be separated from the plate e.g. by a collar of nylon to prevent friction between the tube and the circular end plate.

A fixed baffle plate may also be provided in the chamber upstream from the outlet. This either has an arcuate opening or cut out at the bottom, or is spaced from the wall of the chamber by a short distance, to allow material to pass through to the outlet.

This baffle plate, which is fixed in that it does not rotate with the chamber, assists the accurate dispensing of the material through the outlet, by reducing any tendency of the material to surge, and also decreasing the amount of airborne dust which can reach the outlet.

This baffle plate together with the previously-mentioned end plate may be mounted on a common shaft which is coaxial with the chamber and which extends through the narrower end of the chamber to a fixed mounting.

The baffle plate may either be fixed at a definite distance from the end plate, or it may alternatively be axially displaceable within the chamber. Thus, by moving the baffle plate in the frustoconical chamber, the distance between the edge of the baffle plate and the chamber wall may be varied, and this enables the rate of flow of the material through the chamber to be further controlled. The movable baffle plate may be located by a pin fitting into one of a plurality of axially-spaced holes in the shaft. The baffle plate may also be removable.

The baffle plate may also be used to support the scouring means, where such is present.

In an alternative arrangement, the baffle plate may be mounted rigidly on the shaft, and the frustoconical chamber may be axially displaceable relative to the shaft and baffle plate assembly. Thus, by axially-displacing the cone, the gap between the edge of the baffle plate and the inside of the cone may be increased or decreased in width. In this embodiment, the portion of the shaft which projects from the narrow end of the frustoconical chamber may be calibrated so that by aligning a particular calibration with the end of the chamber or a marking on the chamber a gap between the baffle plate and the interior of the chamber of a desired width may be selected. The interior of the chamber is preferably stainless steel or another highly polished material to minimise the risk of the particulate material adhering to it.

The chamber, and, if used, the coaxial cylindrical tube containing the material, may be rotated mechanically, preferably by a variable-speed electric motor. The drive from the motor may be transmitted to the chamber or tube by any conventional means, but preferably via a friction roller in contact with the chamber or cylinder or by means of toothed gears. Reduction gearing has to be employed to enable the chamber or tube to rotate sufficiently slowly. The chamber or chamber and tube assembly may be supported on a frame at the desired angle by idling rollers which permit axial rotation.

Apparatus embodying the invention for dispensing particulate material will now be described in more detail by way of example and with reference to the accompanying drawings.

Figure 1:
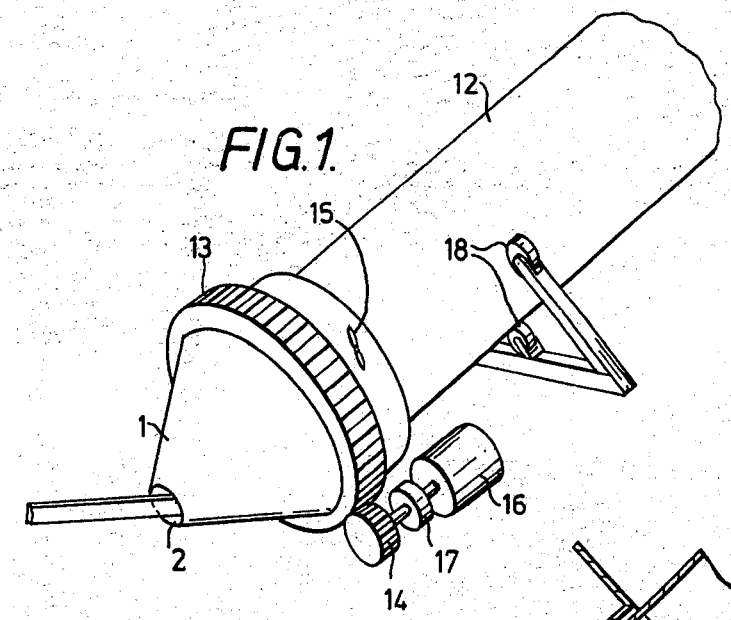
FIG. 1 is a side elevation showing the general layout of a first apparatus.

The apparatus comprises a frustoconical chamber 1 having an outlet 2 at the narrower end. The cone angle is about 70°. The chamber is mounted in such a way that the lower part of the frustoconical wall is horizontal or alternatively, slopes at an angle of up to about 5° upwardly from the inlet.

An end plate 3 (see FIG. 2) is housed at the wider end of the chamber. This plate is circular, non-rotatable, and coaxial with the chamber. It has a small opening at the bottom which acts as an inlet 4 for particulate material. This end plate 3 is mounted on a shaft 5 which also supports a baffle plate 6 within the chamber 1. The shaft and baffle plate are also coaxial with the chamber, and there is a gap between the baffle plate and the chamber wall, the lower part 7 of which enables material to pass the baffle plate on its way from the inlet to the outlet of the chamber.

The shaft 5 has a horizontal extension 8 outside the chamber which can be clamped in position to support the plates 3 and 6. A brush 9 of stiff nylon monofilaments 10 is mounted on the shaft 5 and is fixed relative to it.

The filaments 10 touch the chamber wall so that when the chamber rotates the filaments brush off any particulate material adhering to the wall.

Integral with the wider end of the chamber 1 is a cylindrical sleeve 11, the arrangement being such that the end plate 3 separates the chamber 1 from this sleeve. The drawings show an open ended cylindrical tube 12 (e.g. of cardboard) acting as a container for the particulate material and received within the sleeve 11. The arrangement is such that the slot 4 is aligned with the lowermost part of the cylindrical wall of the tube 12.

The sleeve 11 and cylinder 12 may be clamped together by one or more clamping screws 15.

A large nylon gearwheel 13 is fastened around and coaxial with sleeve 13. This gearwheel co-operates with a pinion 14 which is operatively attached to an electric motor 16 through a gearbox 17. The pinion has fewer teeth than the gearwheel so that in operation the gearwheel rotates much more slowly than the pinion, and preferably not more than 40 r.p.m. for non free-flowing materials. The tube 12 is supported by idler rollers 18.

In operation the cylindrical tube 12 containing particulate material is fixed to the sleeve 11 as described above, and the motor started so that the tube and chamber 1 rotate. The material tends to move towards the lowermost part of the tube under gravity, and to flow through the inlet 4 into the chamber 1. The relative rotation between the plate 3 on the one hand and the tube 12 and chamber 1 on the other hand helps to agitate the material and discourage the formation of lumps in the material in the lower part of the tube. As the material flows through the inlet 4 into the chamber it becomes less compacted and therefore flows in a regular fashion towards the baffle plate 6. The brush 9 removes any material which sticks to the chamber wall as it rotates. The baffle plate 6 helps to control the steady flow of the material towards the outlet 2, the material flows through the gap 7 between the baffle plate and the chamber wall.

The rate of flow of the material may be controlled by varying the speed of rotation of the chamber and tube; the faster the rotation, the faster the flow.

If the lower part of the chamber slopes upwards at a small angle from the outlet towards the inlet, this tends to encourage uniform flow and prevent surging, and also prevents material from being dispensed through the outlet when the chamber is stationary.

When it is desired to make up a mixture from several different particulate materials, several of the above described apparati can be arranged to dispense into the same container.

One important application is in the dispensing of powdered pigments or pigment blends where it is necessary to measure accurately the proportions of the various pigments or pigment blends.

Figure 3:
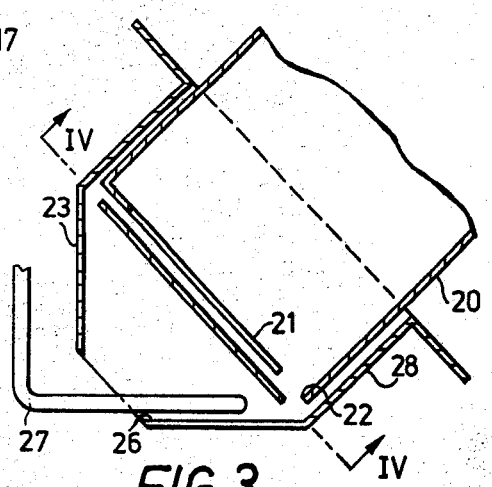
FIG. 3 is a longitudinal section, partly broken away, of part of a second apparatus.
Figure 4:
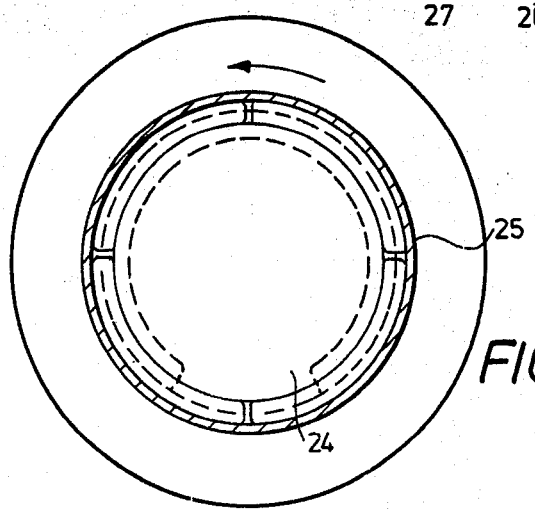
FIG. 4 is a cross-section taken along the line IV-IV of FIG. 3.

A different apparatus according to the invention is shown in FIGS. 3 and 4. In this apparatus the lower end of the tube 20 is provided with a circumferential internal flange 21, having a small opening 22.

The tube is not rotated, although the frustoconical chamber 23 is rotated about its axis of symmetry. The end plate 24 is fixed to the inside of the chamber at the wider end thereof by four narrow ties 25 and is spaced from the chamber wall so that material can always pass the end plate on its way to the inlet 26. A sufficiently large gap 22 is provided between the cylindrical wall of the tube 20 and the cylindrical sleeve 28 which is integral with the chamber to discourage any tendency for particulate material to become trapped between the cylindrical wall and the sleeve.

The probe 27 (which is optional) projecting into the chamber helps to agitate the material and induce uniform flow.

Figure 5:
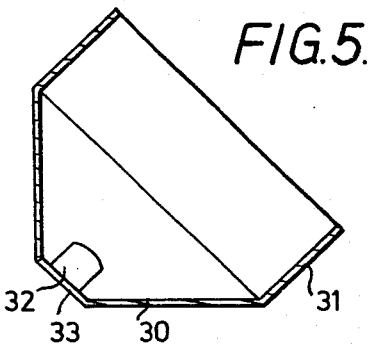
FIG. 5 is a longitudinal section showing an alternative form of chamber.

FIG. 5 shows a frustoconical chamber 30 and integral sleeve 31 which is interchangeable with those described above. It differs from them in that the outlet 32 is in the frustoconical wall of the chamber, the narrow end 33 of the chamber being closed. Particulate material is discharged through this outlet only when the outlet is facing downwards so that separate doses of material are dispensed as the chamber rotates. Apparatus fitted with this chamber may therefore be used to fill a series of containers with measured doses of material.

Figure 6:
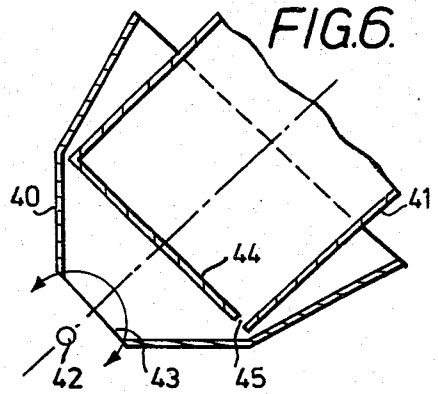
FIG. 6 is a longitudinal section, partly broken away, of a further apparatus of the invention.

FIG. 6 shows a further apparatus according to the invention in which the chamber 40 and attached tube 41 of particulate material are mounted so that they can be tilted about a pivot axis 42. This enables the rate of flow of material through the outlet 43 to be varied, so that in this apparatus a constant-speed motor (not shown) may be employed. The tube 41 is not rotatable, the lower end is closed by an end wall 44 having a narrow outlet 45.

Figure 2:
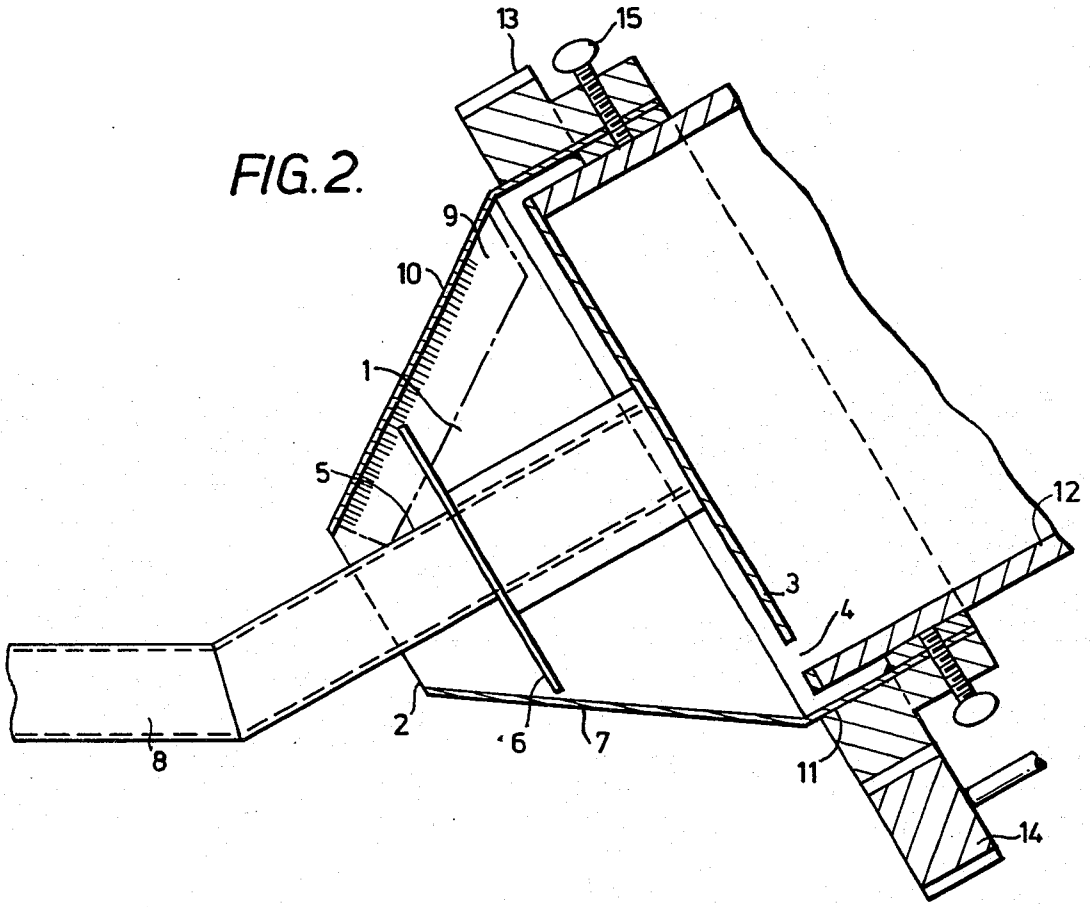
FIG. 2 is a longitudinal section of a portion of the apparatus of FIG. 1, showing the method of dispensing in detail.
Figure 7:
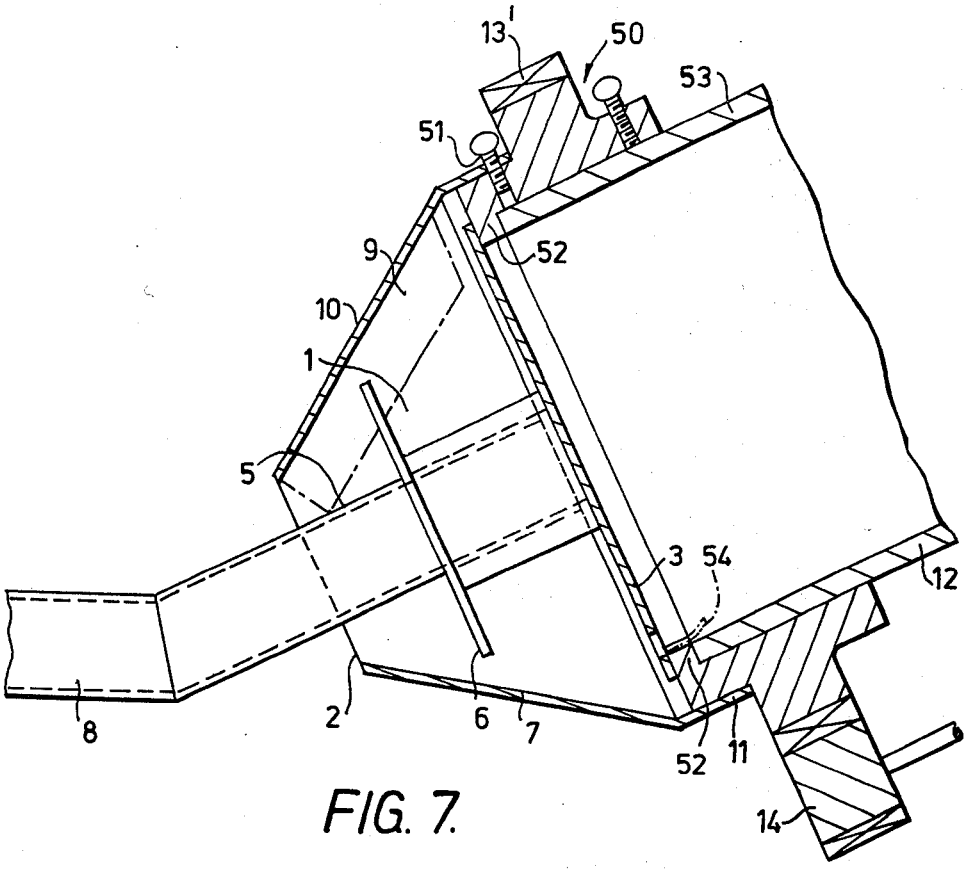
FIG. 7 is a longitudinal section of a portion of a yet further apparatus according to the invention, generally similar to that shown in FIGS. 1 and 2, but with a nylon collar separating the end plate and the cylinder.

FIG. 7 shows an apparatus generally similar to that shown in FIGS. 1 and 2. However, it differs in that the gearwheel 13 is replaced by an annular nylon collar 50. A first end of this collar fits inside the sleeve 11 and is held in place by a locking screw 51. This screw and two similar locking screws (not shown) are spaced uniformly around the circumference of the collar. The other end of the collar 50 fits around the end of the cylindrical tube 12. The edge of the tube abuts against an annular internal flange 52 on the first end of the collar 50. The tube is held in place in the collar by a locking screw 53. This screw and two similar locking screws (not shown) are spaced uniformly around the circumference of the collar.

Between these two sets of screws is a gearwheel 13' integral with the collar 50. A probe 54 consisting of a short stainless steel prong 54 extends perpendicularly from the end plate 3 adjacent one side of the slot 4 and abuts with the inner extremity of the flange 52. The probe serves two purposes:

1. It helps to agitate particulate material around the slot and prevent clogging, particularly when nonfree-flowing powders are being dispersed.

2. As it is diammetrically opposite the brush 9, the brush and probe together tend to brace the assembly and impart rigidity to it.

In any other embodiment of the invention, an agitator or probe may be attached to the end plate so that it projects into the tube of particulate material to be dispensed. This probe may be a pair of diammetrically opposed prongs projecting perpendicularly from the end plate and touching the inside of the tube, the prongs being linked by a cross-piece.

What I claim is:

1. An apparatus for dispensing a particulate material comprising a container section for holding the material to be dispensed, and a frustoconical chamber section, said frustoconical chamber section having a narrow end portion which serves as an outlet for the material and a wide end portion, a circular end plate adapted to substantially cover the wide end portion of the frustoconical chamber section and to separate said chamber section from the container section, said circular end plate defining a circumferential inlet which enables the material to pass from the container section into the frustoconical chamber section, said frustoconical chamber section and container section being mounted for axial rotation with their axis at such an angle to the horizontal that the portion of the frustoconical wall which at any instant is lowermost is either horizontal or slopes upwards at a small angle from the circumferential inlet towards the outlet, said circular end plate being fixed so that it does not rotate with the frustoconical chamber and container sections, thereby acting as an agitator for the particulate material and ensuring that the material flows continuously through the circumferential inlet to replace material discharged through the outlet, a probe means attached to the end plate and extending into the inlet between the chamber section and the container section, said probe means agitating the material passing through the inlet, thereby preventing clogging, fixed scouring means disposed within the frustoconical chamber and in operative engagement with the sides thereof for wiping the inside of said chamber as it rotates to loosen any material adhering to the chamber wall and means provided for rotating the frustoconical chamber section and the container section relative to the circular end plate.

2. The apparatus according to claim 1, wherein the scouring means is associated with the frustoconical chamber wall in the upper part of the chamber section.

* * * * *